US005454137A

United States Patent [19]

Reeves

[11] Patent Number: 5,454,137

[45] Date of Patent: Oct. 3, 1995

[54] VACUUM HOSE ASSEMBLY

[76] Inventor: James A. Reeves, 1003 Taylor Rd., Juliette, Ga. 31046

[21] Appl. No.: 273,486

[22] Filed: Jul. 11, 1994

[51] Int. Cl.[6] ..... A47L 5/14

[52] U.S. Cl. ..... 15/345; 15/401

[58] Field of Search ..... 15/345, 401, 346

[56] References Cited

U.S. PATENT DOCUMENTS

| | | | |
|---|---|---|---|
| 2,181,487 | 11/1939 | Khuen-Kryk | 15/345 |
| 2,879,530 | 3/1959 | Ego | 15/401 X |
| 3,484,890 | 12/1969 | Case | 15/346 |
| 3,694,848 | 10/1972 | Alcala | 15/346 |
| 3,808,631 | 5/1974 | Shibata et al. | 15/401 X |
| 3,967,341 | 7/1976 | Gavin | 15/345 |
| 4,947,515 | 8/1990 | Ivarsson | 15/401 |

FOREIGN PATENT DOCUMENTS

| | | | |
|---|---|---|---|
| 167076 | 2/1956 | Australia | 15/345 |
| 2455878 | 1/1981 | France | 15/346 |
| 2609908 | 7/1988 | France | 15/345 |
| 3421367 | 12/1985 | Germany | 15/345 |
| 4135406 | 5/1992 | Germany | 15/346 |
| 145102 | 12/1978 | Japan | 15/345 |

*Primary Examiner*—Christopher K. Moore

[57] ABSTRACT

A vacuum hose assembly comprising an elongate tube member having a first end spaced from a second end, with a rigid blade fixedly mounted to the elongate tube coaxially thereof projecting beyond the first end, with first and second conduits directing pressurized air from the first end towards the rigid blade to effect agitation of debris within an underlying carpet as the blade displaces piling and nap within the carpet for access to the pneumatic air from the conduits, and a suction source mounted to the elongate tube at the second end to direct vacuum throughout the tube and direct that debris through the tube for subsequent collection. A valve assembly is in operative communication with a pressure hose to direct selective pressurized air from the pressure hose to the first and second conduits.

4 Claims, 4 Drawing Sheets

VACUUM HOSE ASSEMBLY

TECHNICAL FIELD

The field of invention relates to vacuum hose structure, and more particularly pertains to a new and improved vacuum hose assembly to permit the organization to separate nap of carpeting, particularly in an automotive environment, and simultaneously direct pressurized air at the separated nap while applying a vacuum supply to that nap to remove debris from the carpet structure.

BACKGROUND OF THE INVENTION

Prior art structure relative to vacuum hose organizations is available and exemplified in U.S. Pat. No. 4,524,808 wherein a vacuum hose includes a main vacuum hose and outer surface for carrying electrical line.

U.S. Pat. No. 4,881,909 sets forth a vacuum hose for use with a vacuum canister with electrical conductor cables directed therethrough for effecting electrical current throughout the hose structure.

U.S. Pat. No. 4,018,493 sets forth a vacuum cleaner hose end arranged for connecting various components to the vacuum hose structure.

SUMMARY OF THE INVENTION

The present invention relates to vacuum structure, and more particularly pertains to a new and improved vacuum hose assembly wherein the same permits a blade member of the organization to separate nap of carpeting, particularly automotive carpeting, and to this end direct pressurized air on opposed sides of the blade structure to free debris from the carpeting and direct such debris into the primary portion of the hose, whereupon a vacuum source directs such debris through the hose structure.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
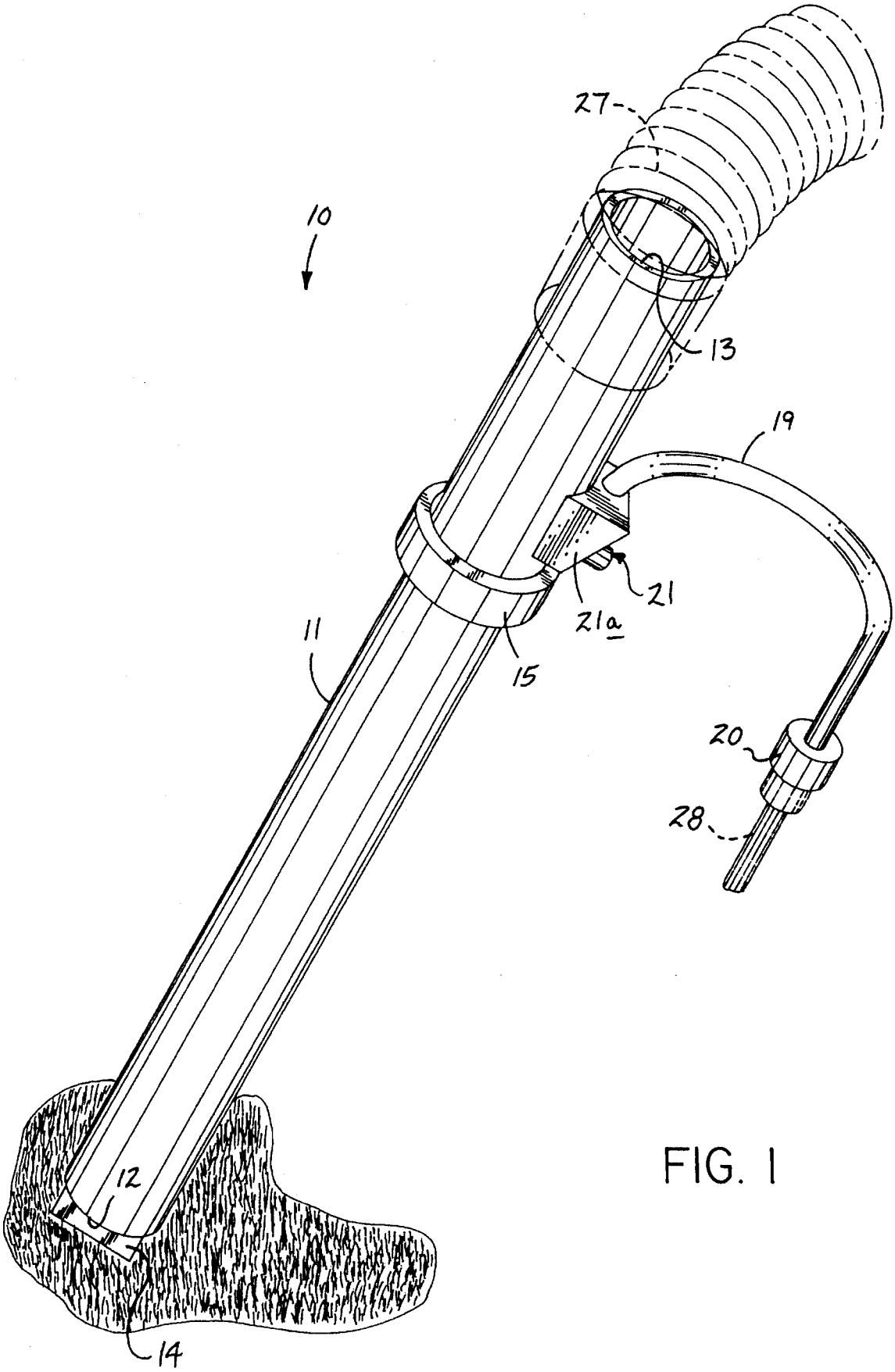
FIG. 1 is an isometric illustration of the invention.
Figure 2:
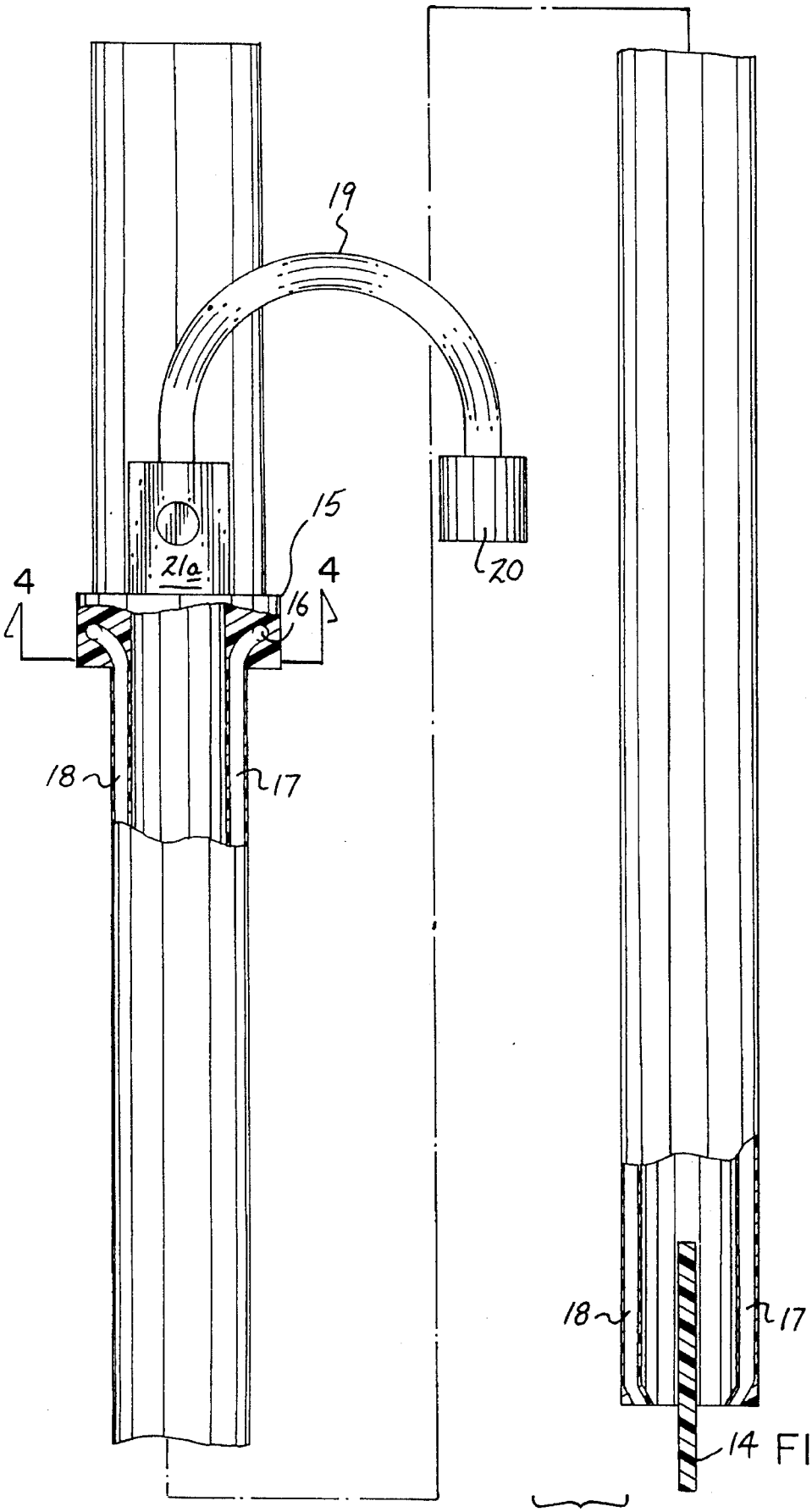
FIG. 2 is an orthographic view, partially in section, indicating the hose structure.
Figure 3:
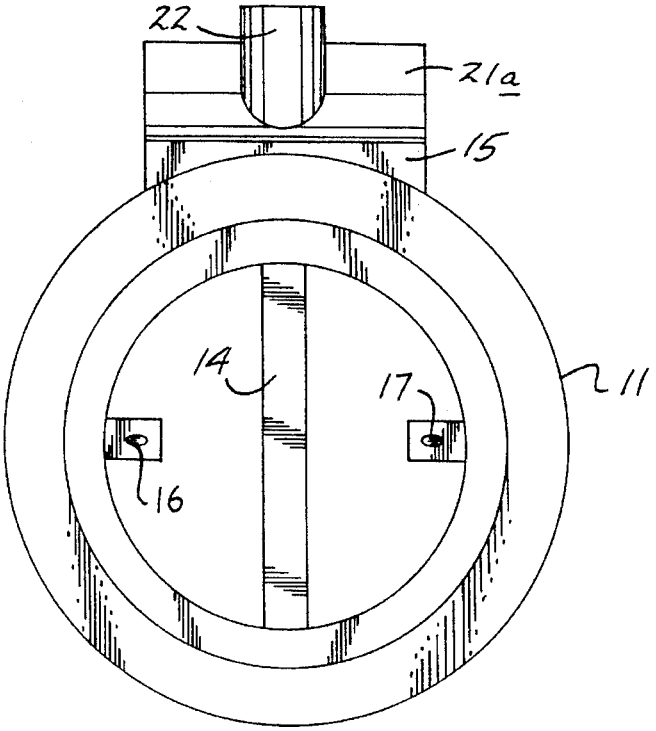
FIG. 3 is an orthographic bottom end view of the hose assembly.
Figure 4:
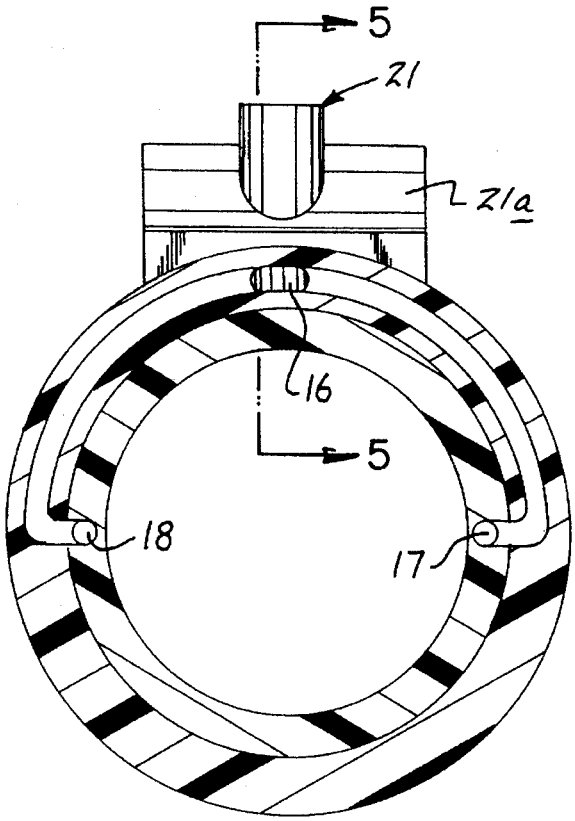
FIG. 4 is an orthographic view, taken along the lines 4—4 of FIG. 2 in the direction indicated by the arrows.
Figure 5:
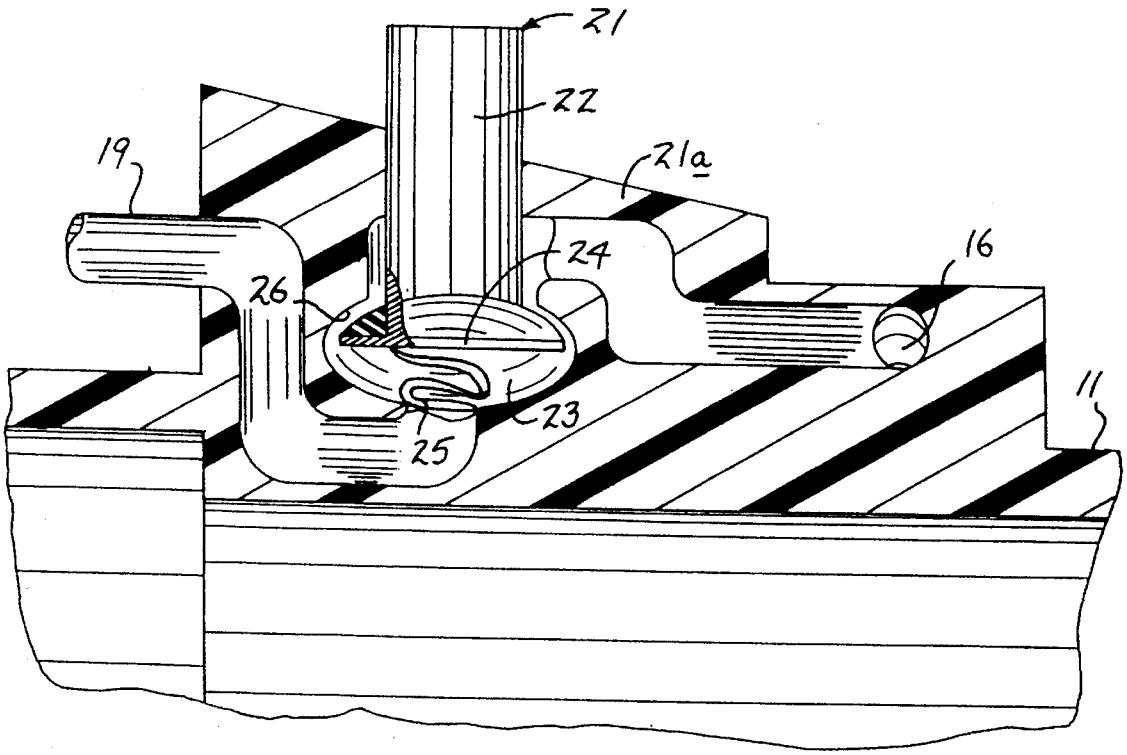
FIG. 5 is an orthographic view, taken along the lines 5—5 of FIG. 4 in the direction of the arrows.

The vacuum hose assembly 10 of the invention as indicated in FIG. 1 comprises an elongate tube 11 typically of a rigid construction, but if necessary such tube structure may be of a flexible or semi-flexible configuration if so desired. The elongate tube 11 is formed with a first end 12 spaced from a second end 13, with a rigid blade 14 fixedly mounted to the tube's first end 12 extending exteriorly thereof and beyond the tube's first end, with the rigid blade coaxially aligned relative to the elongate tube 11, such as indicated in FIG. 2. The rigid blade 14 is arranged to project into the nap portion of carpeting, such as illustrated in FIG. 1, to separate such nap for purposes to be described in more detail below. A collar 15 is fixedly mounted to the elongate tube 11 between the first end 12 and second end 13. The collar 15 is provided with a collar conduit 16 in pneumatic communication with a first pressure conduit 17 and second pressure conduit 18 that extend from the collar conduit 16 to the first end 12 and terminate on opposed sides of the rigid blade 14 and are canted towards the rigid blade 14, such as indicated in FIG. 2, to direct pressurized air from the pneumatic pressure source 28, such as illustrated in FIG. 1, to a pressure hose 19, through a valve member 21, to the collar conduit 16 and subsequently to the first and second pressure conduits 17 and 18. The coupler 20 of any convenient type is arranged for the quick securement of the pneumatic pressure source 28 to the pressure hose 19. A pneumatic vacuum source 27 is arranged for securement to the tube's second end 13 to direct pressurized air throughout the elongate tube 11, such that when the pressurized air is directed to the carpeting structure on opposed sides of the blade 4, debris and the like is loosened and thereafter drawn into the tube 11 for removal to a convenient receptacle (not shown) that is typically attached to the vacuum source 27. A valve member 21 is illustrated in detail in FIG. 5, such that a valve rod 22 is directed into a valve boss 21*a* that in turn is fixedly secured to the tube 11. The valve rod 22 terminates within a valve chamber 23 within the valve boss 21*a*. Within the valve chamber 23 is a valve plate 24 arranged for seating upon a valve seat 26, with the valve plate biased to the valve seat 26 by a spring 25. Projection of the valve rod 22 from the valve seat 26 permits pneumatic pressurized air directed from the pressure hose 9 to be directed through the valve chamber 23 to the collar conduit 16.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A vacuum hose assembly, comprising, an elongate tube, the tube having a first end spaced from a second end, a rigid blade fixedly mounted to the tube at the first end, with the rigid blade projecting beyond the first end, and pressurized pneumatic means extending along the tube and terminating at the first end for directing pressurized pneumatic air to an underlying carpet member, and vacuum means selectively securable to the second end for directing a suction through the elongate tube from the first end through the second end.

2. A vacuum hose assembly as set forth in claim 1 wherein the pneumatic means includes a collar fixedly secured to the elongate tube between the first end and the second end, with the collar having a collar conduit extending therethrough, with the collar conduit in pneumatic communication with a first conduit and a second conduit, the first conduit and the second conduit extending along the elongate tube from the collar to the first end.

3. A vacuum hose assembly as set forth in claim 2 wherein the first conduit and the second conduit terminate in a first conduit exit port and a second conduit exit port, with the first conduit exit port and the second conduit exit port positioned on opposed sides of the rigid blade, and the first conduit and the second conduit canted towards the rigid blade from the elongate tube.

4. A vacuum hose assembly as set forth in claim 3 including a valve member fixedly mounted to the elongate tube adjacent the collar, with the valve member including a valve boss, with the valve boss having a valve rod reciprocatably mounted within the valve boss, and the valve rod directed into a valve chamber within the valve boss, and the valve rod having a valve plate within the valve chamber, and the valve chamber having a valve seat for selective engagement with the valve plate, and a spring member biasing the valve plate in engagement with the valve seat.

* * * * *